US010935027B2

(12) United States Patent
Obrist et al.

(10) Patent No.: US 10,935,027 B2
(45) Date of Patent: Mar. 2, 2021

(54) SEPARATOR DEVICE FOR SEPARATING A FLUID, IN PARTICULAR A LUBRICANT, FROM A COOLANT

(71) Applicant: OET GmbH, Lustenau (AT)

(72) Inventors: Oliver Obrist, Dornbirn (AT); Frank Obrist, Bregenz (AT); Peter Giese, Herzogenaurach (DE)

(73) Assignee: OET GmbH, Lustenau (AT)

( * ) Notice: Subject to any disclaimer, the term of this patent is extended or adjusted under 35 U.S.C. 154(b) by 176 days.

(21) Appl. No.: 16/094,831

(22) PCT Filed: Apr. 19, 2017

(86) PCT No.: PCT/EP2017/059275
§ 371 (c)(1),
(2) Date: Oct. 18, 2018

(87) PCT Pub. No.: WO2017/182516
PCT Pub. Date: Oct. 26, 2017

(65) Prior Publication Data

US 2019/0120231 A1 Apr. 25, 2019

(30) Foreign Application Priority Data

Apr. 19, 2016 (DE) ..... 10 2016 107 194.3

(51) Int. Cl.
*F04C 29/02* (2006.01)
*F25B 43/02* (2006.01)
(Continued)

(52) U.S. Cl.
CPC ..... *F04C 29/026* (2013.01); *F04B 39/02* (2013.01); *F04B 39/121* (2013.01); *F04B 39/16* (2013.01);
(Continued)

(58) Field of Classification Search
CPC ..... F04C 29/026; F04C 28/24; F25B 43/02; F04B 39/121; F04B 53/22
See application file for complete search history.

(56) References Cited

U.S. PATENT DOCUMENTS 4,441,871 A 4/1984 Boller
5,823,294 A 10/1998 Mizutani et al.
(Continued)

FOREIGN PATENT DOCUMENTS

CN 104948460 A 6/2017
DE 19723628 A1 12/1997
(Continued)

OTHER PUBLICATIONS

Japanese Office action dated Mar. 18, 2020, JP Patent Application No. 2018-554545 and English translation.
(Continued)

*Primary Examiner* — Frantz F Jules
*Assistant Examiner* — Lionel Nouketcha
(74) *Attorney, Agent, or Firm* — Cesari and McKenna, LLP

(57) ABSTRACT

The invention relates to a separator device of a compressor for the deposition of a fluid, in particular a lubricant from a coolant fluid of the compressor, including a separator cylinder having an inlet region for the coolant fluid and an outlet region for the deposited fluid spaced apart from inlet in an axial direction of the cylinder, and a separation tube configured and arranged coaxially in the separator cylinder. The separation tube extends at least over the inlet region of the separator cylinder such that the separation tube is spaced apart from the separator cylinder in a radial direction in the inlet region. A spring-loaded closure is configured and arranged in the inlet region to automatically regulate a flow
(Continued)

Figure 1:
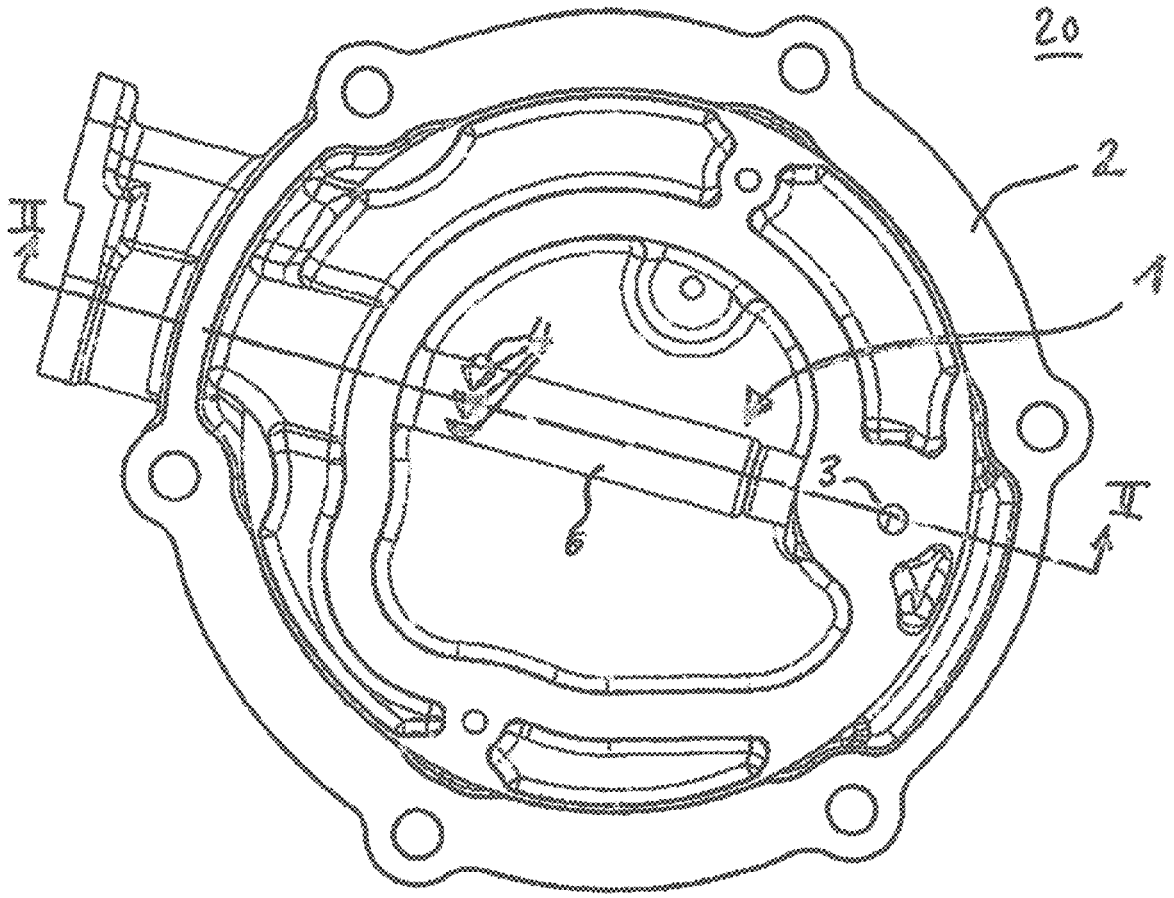

velocity of a volume flow of the coolant fluid flowing through the inlet as a function of a pressure at the inlet.

20 Claims, 7 Drawing Sheets

(51) Int. Cl.

| | |
|---|---|
| ***F04C 28/24*** | (2006.01) |
| ***F04C 29/12*** | (2006.01) |
| ***F04B 39/12*** | (2006.01) |
| ***F04B 39/16*** | (2006.01) |
| ***F04B 53/20*** | (2006.01) |
| ***F04B 53/22*** | (2006.01) |
| ***F04B 39/02*** | (2006.01) |

(52) U.S. Cl.
CPC ..... *F04B 53/20* (2013.01); *F04B 53/22* (2013.01); *F04C 28/24* (2013.01); *F04C 29/122* (2013.01); *F25B 43/02* (2013.01)

(56) References Cited

U.S. PATENT DOCUMENTS

| | | | | |
|---|---|---|---|---|
| 6,582,500 | B1 * | 6/2003 | Ohadi | B03C 3/16 55/DIG. 38 |
| 7,736,136 | B2 | 6/2010 | Ohtake | |
| 9,291,165 | B2 | 3/2016 | Obrist et al. | |
| 2007/0140870 | A1 * | 6/2007 | Fukanuma | F04C 29/026 417/269 |
| 2007/0144206 | A1 * | 6/2007 | Tsuboi | F25B 41/062 62/470 |

FOREIGN PATENT DOCUMENTS

| | | | |
|---|---|---|---|
| DE | 102008013784 | A1 | 9/2008 |
| EP | 1798499 | A2 | 6/2007 |
| EP | 1801521 | A2 | 6/2007 |
| EP | 2806165 | A1 | 11/2014 |
| EP | 2960501 | A2 | 12/2015 |
| GB | 711576 | A | 7/1954 |
| JP | 05296610 | | 6/1995 |
| JP | 1997-324758 | | 12/1997 |
| JP | 2007-162561 | | 6/2007 |
| JP | 2007-170783 | | 7/2007 |

OTHER PUBLICATIONS

English Translation of PCT Written Opinion of the International Searching Authority, International Application No. PCT/US2017/059275, dated Jul. 5, 2017, 8 pages.

* cited by examiner

A-A

SEPARATOR DEVICE FOR SEPARATING A FLUID, IN PARTICULAR A LUBRICANT, FROM A COOLANT

CROSS REFERENCE TO RELATED APPLICATIONS

This application is the National Stage of International Application No. PCT/EP2017/059275, filed Apr. 19, 2017, which claims the benefit of German Patent Application No. 102016107194.3 filed on Apr. 19, 2016. The contents of both applications are hereby incorporated by reference in their entirety.

TECHNICAL FIELD

The present disclosure relates to a separator device of a compressor for separating a fluid, in particular a lubricant, from a coolant flowing in the compressor.

The invention relates to a separator device for the deposition of a fluid, in particular a lubricant from a coolant fluid, which comprises a separator cylinder and a separation tube arranged coaxially therein. The separator cylinder has an inlet region having at least one inlet for the coolant fluid and an outlet region spaced apart therefrom in the axial direction for the deposited fluid. The separation tube extends at least over the inlet region of the separator cylinder such that the separation tube is spaced apart from the separator cylinder in the inlet region in the radial direction.

Cooling circuits of, for example, refrigerators or air conditioners, typically include compressors for compressing a coolant whose mechanical components must be lubricated during operation by means of a lubricant. As a result, the coolant compressed in the compressor is inevitably contaminated with lubricant, in particular oil. The lubricant is usually contained in the form of an oil mist and thus forms a coolant fluid with the coolant. It is understood that the remaining components of the cooling circuit may not be contaminated with lubricant, so that typically separator devices or oil separators are provided on the outlet side of the compressor for separating the lubricant contained in the coolant fluid.

Separator devices for compressors are known in the prior art in which a separation tube (or dip tube) is provided within a separator cylinder, which is typically part of a compressor housing. Such separator devices have an outlet for the coolant largely freed of the lubricant and another outlet which is fluidly connected to a collecting tank for lubricant or oil.

The compressed coolant fluid is introduced through an inlet into the separator cylinder to separate the coolant from the lubricant. The coolant fluid circulates within the separator cylinder around the separation tube wherein centrifugal forces act on the constituents of the flowing coolant fluid. Portions of the lubricant usually have a higher mass than the typically gaseous coolant, so that the lubricant can be separated from the coolant by the centrifugal forces acting on the coolant fluid. In this case, due to its higher mass, the lubricant initially collects on an inner wall of the separator cylinder or of the separation tube and flows downwards, whereas the gaseous coolant can escape through the separation tube in the opposite direction. The coolant escaping from the separation tube is supplied to the further components of the cooling circuit. The deposited lubricant flows into the collecting tank and thus can be recycled to lubricate the mechanical components of the compressor.

Patent application DE 10 2008 013 784 A1 shows a compressor having an oil separator for separating oil from a coolant. The oil separator comprises a separator cylinder having inlet and outlet openings. A separation tube is used within the separator cylinder. An outlet for the coolant is provided in the upper part of the separator cylinder, which coolant is supplied to the coolant circuit after the lubricant or the oil has been removed. The lubricant or oil is supplied via the lower part of the separator cylinder to a storage container.

A problem that arises in the operation of such separator devices is that often no consistently good separation results can be achieved under varying operating conditions.

It is an object of the present invention to further improve a separator device of the type mentioned above so that a sufficient separation of lubricant and coolant is made possible even under varying operating conditions.

This object is achieved by a separator device having the further features of claim 1. Advantageous embodiments and further developments emerge from the dependent claims.

A separator device for the deposition of a fluid, in particular a lubricant from a coolant fluid, comprises

- a separator cylinder having an inlet region having at least one inlet for the coolant and an outlet region spaced apart therefrom in the axial direction for the deposited fluid, and
- a separation tube arranged coaxially in the separator cylinder, which tube extends at least over the inlet region of the separator cylinder such that the separation tube is spaced apart from the separator cylinder in the inlet region in the radial direction.

According to the invention, a spring-loaded closure element is arranged in the inlet region, which is configured to automatically regulate the flow velocity of the volume flow of the coolant aerosol flowing through the at least one inlet.

The invention is based on the observation that the degree of deposition depends significantly on the flow velocity of the coolant fluid within the separator cylinder. This flow velocity depends on the volume flow entering the separator device and thus on the rotational speed of the compressor. If this varies, the flow velocity of the coolant fluid at the separation tube changes accordingly, whereby the deposition process can be adversely affected. It is therefore desirable to keep the flow velocity in a constant range, preferably in a constantly high range, independent of the rotational speed.

The effective passage cross-section of the at least one inlet can be changed by means of the spring-loaded closure element. The change in the effective passage cross-section takes place automatically as a function of the inlet pressure prevailing at the inlet. A control and/or regulation requiring complex, possibly electronic components is not necessary for this purpose. The closure element is able to automatically regulate the deposition process within the separator cylinder such that the flow velocity of the coolant fluid in the separator device is maintained at least approximately at a constantly high level even at a varying rotational speed of the compressor. This is achieved by the closure element limiting the effective passage cross-section of the inlet at low pressures, whereas at higher inlet pressures, the closure element automatically opens further. This causes a change in the volume flow passing through the inlet such that the flow velocity of the coolant fluid around the separation tube is almost constant.

Another advantage is that when the compressor is at a standstill, a return flow of the coolant fluid into the compressor is prevented or at least reduced by the closing of the inlet in the absence of a volume flow.

A fluid in the sense of the present specification can be both a gas or a liquid. Carbon dioxide ($CO_2$) is preferably used as a coolant. The coolant fluid may be, for example, an aerosol that includes components of the coolant and the lubricant. In other applications, the lubricant is completely or partially dissolved in the coolant fluid.

Preferably, the spring-loaded closure element automatically regulates the cross-sectional area of the inlet and thus the flow velocity of the volume flow of the coolant aerosol depending on the inlet pressure. The entering coolant fluid exerts a force on the spring-loaded closure element in order to deflect it accordingly. The closure element need not necessarily be configured to completely close the inlet. It is essential that by means of the closure element, the passage cross-section regulating the entering volume flow can be automatically changed as a function of the inlet pressure, wherein the inlet characteristic is essentially predetermined by the spring characteristic curve of the closure element. The at least one inlet is thus automatically at least partially opened or closed again as a function of the inlet pressure, which varies with the rotational speed of the compressor. The flow conditions prevailing within the separator cylinder are thereby almost independent of the inlet pressure or the rotational speed of the compressor, so that a good separation result can be ensured at a nearly constant high level.

According to a possible embodiment of the invention, the closure element is configured such that the at least one inlet can be completely closed. If the inlet pressure falls below a threshold value substantially predetermined by the spring characteristic curve of the spring-loaded closure element, then no coolant fluid flows through the inlet into the separator. The flow velocity of the coolant fluid flow within the separator device is therefore always above a minimum value in order to ensure adequate separation of coolant and lubricant.

In principle, the spring-loaded closure element may comprise a multi-part construction having closure and spring elements. However, the spring-loaded closure element is preferably designed as a curved leaf spring. In other words, a one-piece design of a spring-loaded closure element is thus provided. Such designs are particularly robust and wear-resistant and thus are particularly suitable for long-term use.

Particularly preferably, the leaf spring has a radius of curvature which is smaller than half the inner diameter of the separator cylinder. The leaf spring is preferably inserted into the separator cylinder such that the effective passage cross-section of the at least one inlet can be limited on the inside by the leaf spring.

In a further advantageous embodiment, the radius of curvature of the leaf spring is variable. Advantageously, the position of the leaf spring relative to the opening is determined by the pressure of the incoming fluid which acts on the leaf spring. The adjustability is influenced by the degree of stiffness of the leaf spring. The preferred spring stiffness is in a range such that a deflection of 0.1 to 5 bar/mm is achieved. In a concrete embodiment, the leaf spring is configured as a spiral. Advantageously, the radius of curvature can be adjusted to the degree of regulation of the inlets and the number of inlets. By varying the radius of curvature of the leaf spring, it is possible, for example, to configure progressive spring characteristic curves which can be used, in particular, to suitably regulate the flow behavior within the separator device at particularly high and/or low inlet pressures. In addition, a spiral configuration of the leaf spring or of the closure element has the further advantage that effective flow channels are thereby defined, which deflect the entering volume flow in the tangential direction. This has the consequence that the tangential component of the flow velocity of the coolant fluid flow flowing around the separation tube and thus the centrifugal forces that occur are maximized. Thus, a particularly efficient separation is provided.

In a preferred embodiment, the at least one inlet has a guide channel which extends at least in sections in a direction deviating from the radial direction, so that the volume flow flows into the separator cylinder essentially in a tangential direction. An introduction of the volume flow in the tangential direction promotes the circulation of the volume flow around the separation tube and thus the separation of the constituents contained in the coolant fluid under the effect of the occurring centrifugal forces.

Furthermore, a plurality of inlets circumferentially arranged around the separator cylinder is preferably provided. The flow velocity of the volume flow through the closure element can be regulated even more precisely by the plurality of inlets. For example, it is possible to close only the first inlet of four inlets, so as to influence the flow velocity.

Advantageously, the inlets are arranged in a row extending perpendicular to the axial direction. This promotes the inflow of the volume flow in the tangential direction in the separator cylinder.

The entirety of the inlets can preferably be closed on the inside by the spring-loaded closure element. Advantageously, it is thus possible to prevent a return of the coolant aerosol when the compressor is switched off.

The invention further relates to a compressor, for example, a compressor of an air conditioning system, in particular of a motor vehicle having such a separator device. The associated advantages arise directly from the above description, in particular, a sufficiently good separation of the lubricant can be ensured even with variable rotational speed of the compressor.

In a further embodiment, a compressor is provided with a deposition device for the deposition of a fluid from a fluid-containing aerosol.

Preferably, the compressor is configured such that the separator device can be arranged as a separate unit within a compressor housing and detachably connectable to this. In other words, the separator device forms a separate module which can be inserted into the compressor. This simplifies the function test or maintenance of the separator device or the compressor in a particularly advantageous manner.

The invention is explained in more detail in the following also with regard to further features and advantages with reference to the description of embodiments and with reference to the accompanying schematic drawings.

Shown in this case

Figure 2:
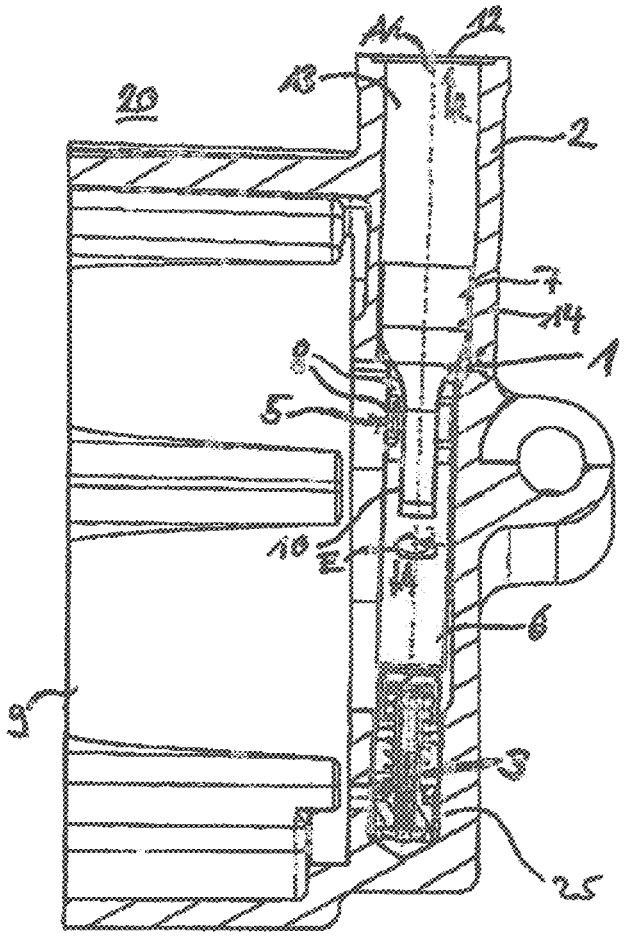
Figure 3A:
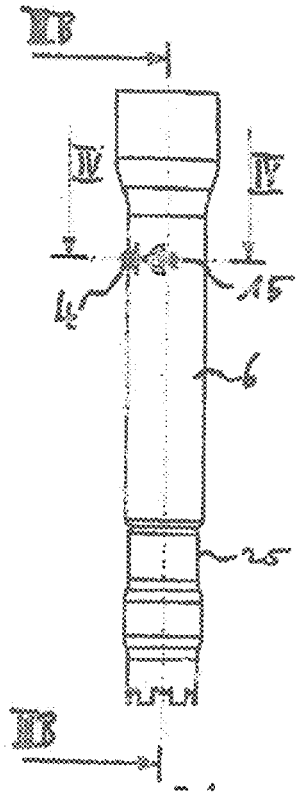
Figure 3B:
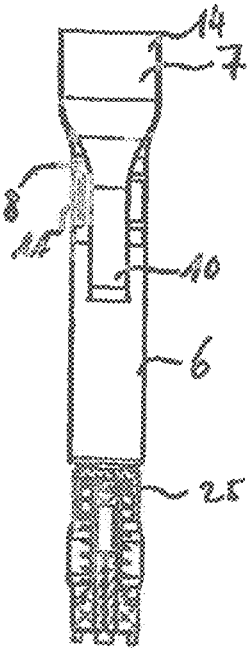
Figure 3C:
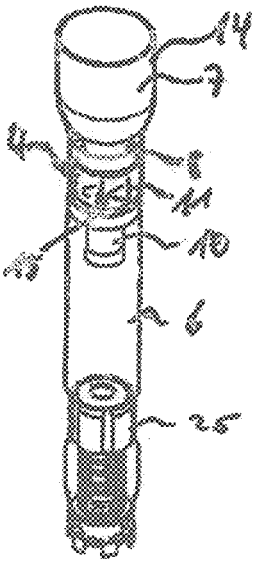
Figure 4:
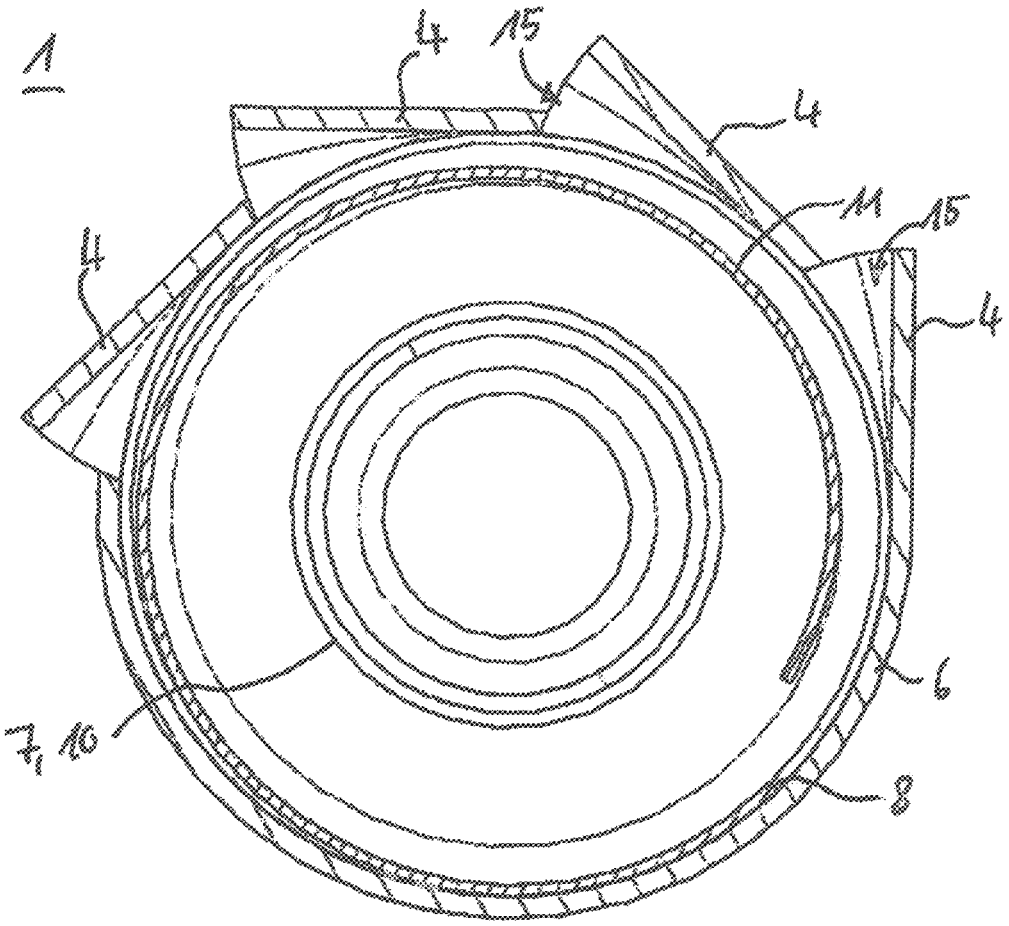
Figure 5:
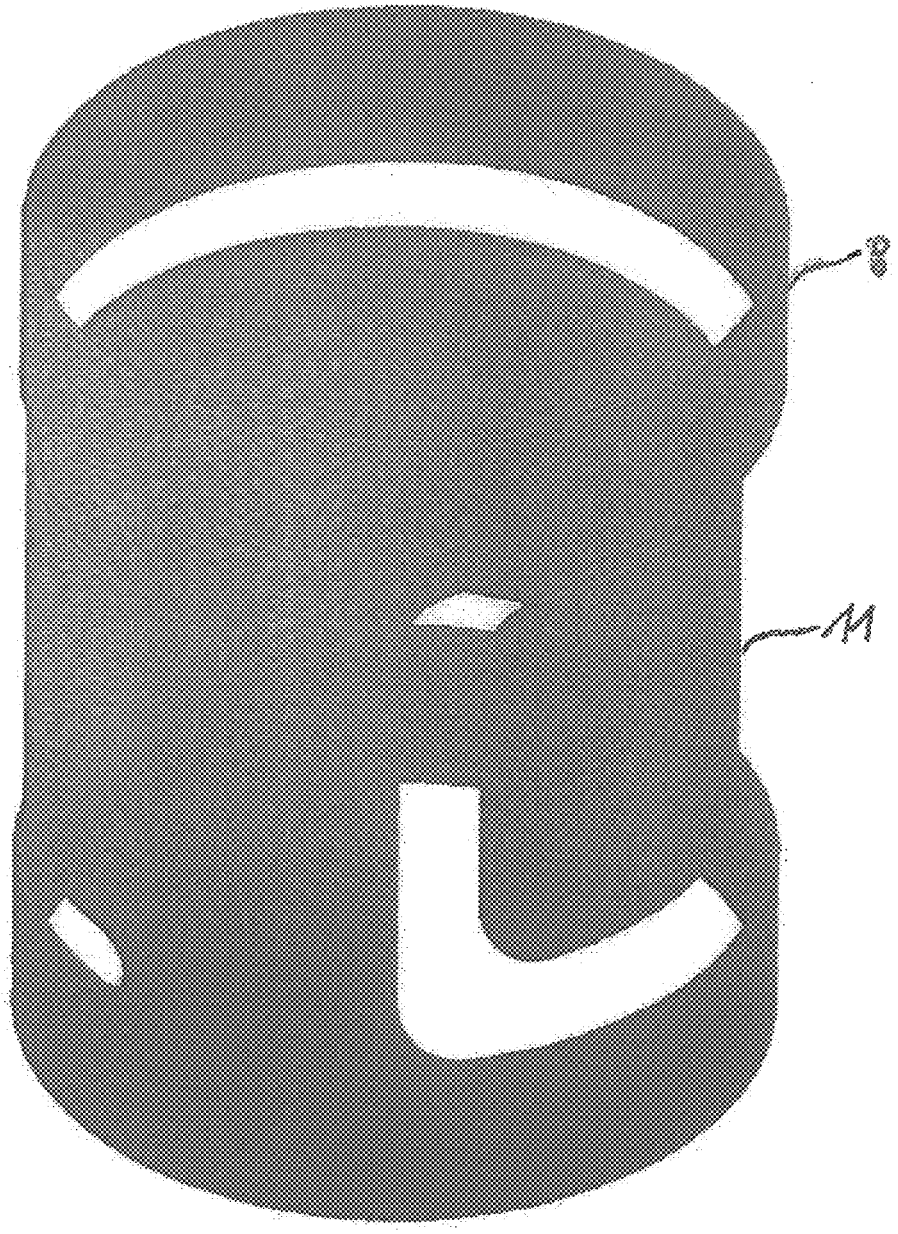
Figure 6:
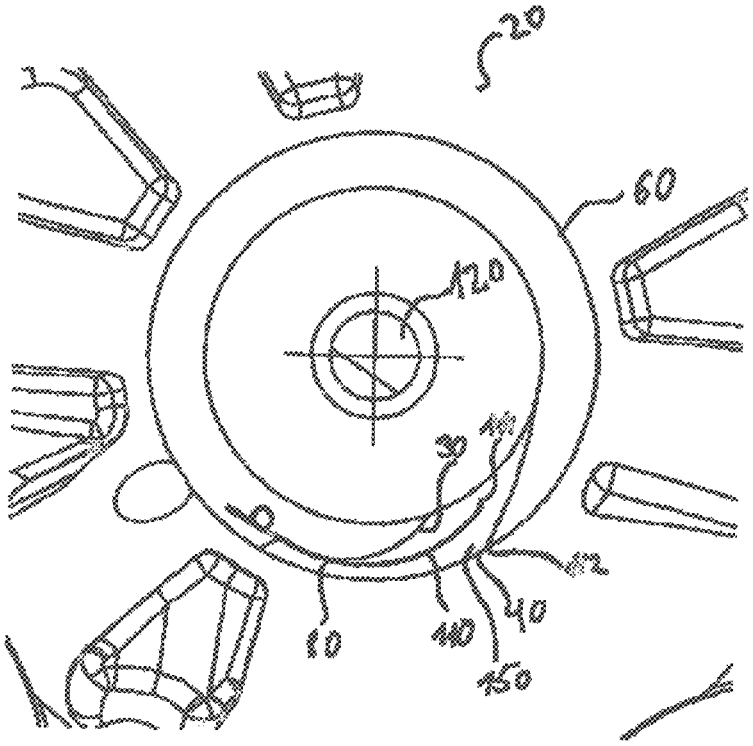
Figure 7:
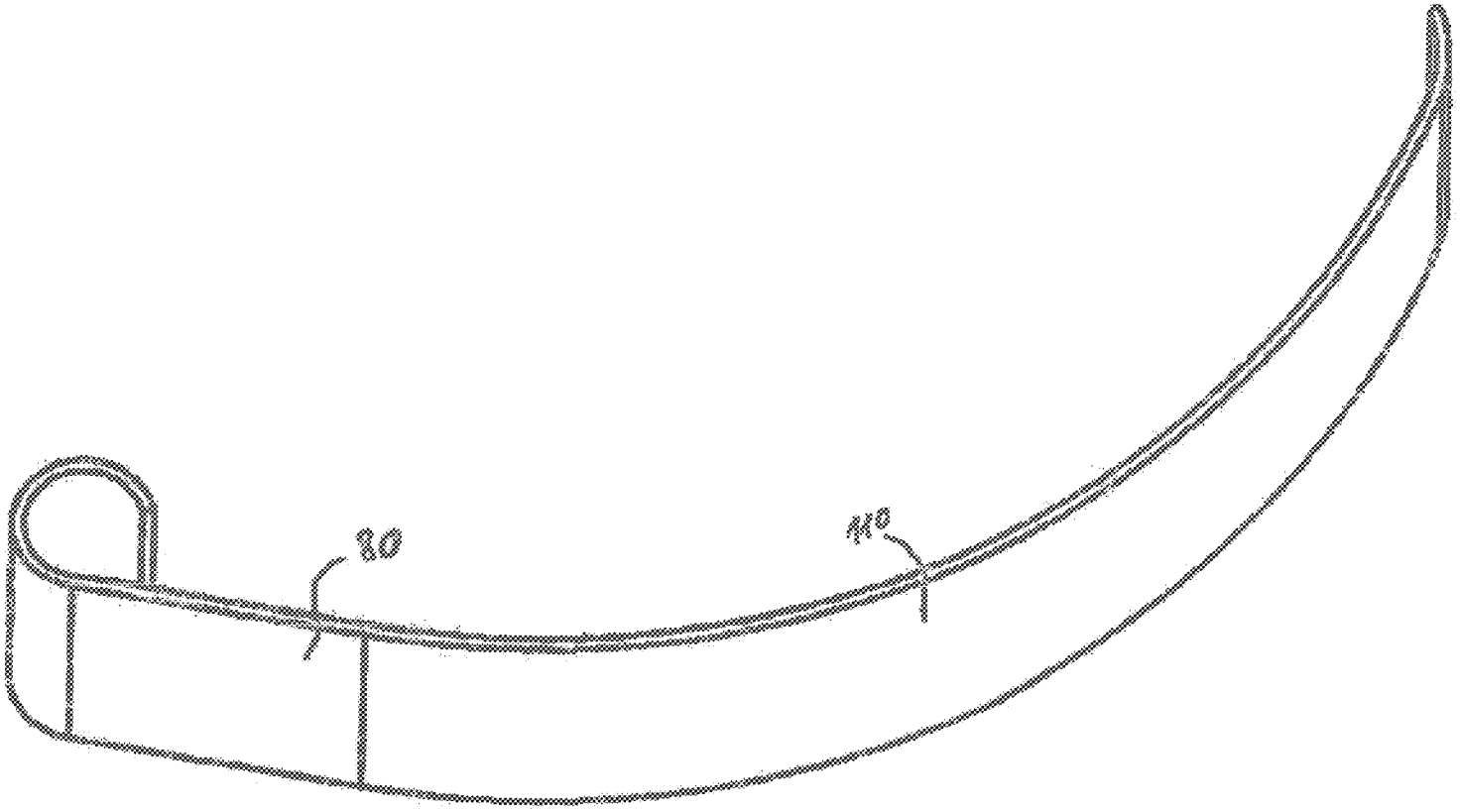

FIG. 1 a housing cover of a compressor housing comprising a separator device according to an embodiment in a plan view, FIG. 2 a side view of the housing cover of FIG. 1, FIG. 3A a separator device having a spring-loaded closure element according to an embodiment in a side view, FIG. 3B the separator device of FIG. 3A in a sectional view, FIG. 3C the separator device of FIG. 3A in a perspective view, wherein a separator cylinder is shown transparent for better representation FIG. 4 a plan view of the separator cylinder in a further sectional view, FIG. 5 the spring-loaded closure element in a perspective view, FIG. 6 a plan view of a separator cylinder having closure element according to a further exemplary embodiment, FIG. 7 a spring-loaded closure element of FIG. 6 in a perspective view.

Parts corresponding to each other are provided with the same reference numerals in all figures.

FIG. 1 and FIG. 2 show a housing cover 2 having a separator device 1 according to an embodiment. The location of the sectional plane II shown in FIG. 2 can be seen in the plan view of FIG. 1. The housing cover 2 is part of a compressor 20, which contains lubricant and coolant within a coolant circuit for compressing a coolant fluid. The coolant fluid in this case is, in at least one concrete application, a heterogeneous mixture of coolant and lubricant. In another application, in particular when carbon dioxide ($CO_2$) is provided as a coolant, the lubricant may also be at least partially dissolved in the coolant. The lubricant is usually oil, which is intended to continuously lubricate the mechanical parts of the compressor. The oil is usually introduced in the form of a mist into the coolant fluid.

The separator device 1 comprises a separator cylinder 6 having a plurality of inlets 4 which are in fluid communication with an inner region of the compressor 20. The coolant fluid flows from the compressor via the inlets 4 into an inlet region 5 of the separator device 1. The separator cylinder 6 is arranged within a hollow cylindrical section 13 of the housing cover 2, for example, by means of a clearance fit. The separator device 1 inserted into the hollow cylindrical section 13 can be removed as a separate module, in particular for maintenance or repair purposes; for this purpose, at most, it is necessary to release a reversible connection, such as, in particular, a screw connection. The housing cover 2 further comprises an outlet region 3 which communicates with a collection basin (not shown) for collecting deposited fluid via a collection basin connection 9.

The section 13 is in operative connection with a not shown cooling circuit via a coolant connection 12. For example, this may be the cooling circuit of a refrigerator or an air conditioner. In order to avoid the coolant fluid containing the lubricant getting into the cooling circuit, the lubricant or the oil must first be deposited.

A separation tube 7 is arranged coaxially in the separator cylinder 6, which tube has a tube section 10 having a reduced diameter, which extends in the direction of the outlet region 3. On the side facing the cooling circuit connection 12, a separation tube section 14 is arranged which has a larger cross-section than the tube section 10. In the exemplary embodiment shown, which is not restrictive, the diameter of the tube section 10 is approximately half of the separator cylinder 6. The separation tube section 14 has an overall cross-section which corresponds approximately to the cross-section of the separator cylinder 6 in this region. The tube section 10 having reduced diameter extends over the inlet region 5, so that the separator cylinder 6 and the separation tube 7 are spaced apart from each other in the radial direction in this region. The coolant fluid flowing through the inlet 4 flows between the inner wall of the separator cylinder 6 and the outer wall of the separation tube 7 in the circumferential direction, wherein centrifugal forces act on the coolant fluid. In other words, the separator device operates in the manner of a centrifugal separator.

As FIGS. 3A to 3C show, a plurality of inlets 4 can be arranged on the separator cylinder 6. The inlets 4 are arranged in a row extending perpendicular to the axis A1 in the exemplary embodiment shown.

The position of the sectional plane IIIB shown in FIG. 3B and the position of the sectional plane IV shown in FIG. 4 can be seen in FIG. 3A.

FIG. 2, FIGS. 3A to 3C and FIG. 5 show a closure element 8 according to one exemplary embodiment. The closure element 8 comprises a spring element which is designed as a leaf spring 11. The leaf spring 11 in this embodiment has a radius of curvature which is smaller than half the inner diameter of the separator cylinder 6. The radius of curvature of the leaf spring 11 varies slightly, so that the leaf spring 11 in the inlet region 5 of the separator cylinder 6 defines flow channels for the inflowing coolant fluid, which promote a circulation of the coolant fluid in the tangential direction around the separation tube 7.

The closure element 8 is arranged within the separator cylinder 6 around the separation tube 7, in particular in the region of the tube section 10. The leaf spring 11 is arranged so that it partially closes, completely closes or does not close at all the inlet(s) 4 depending on the inlet pressure of a penetrating volume flow.

The coolant fluid is introduced as a volume flow via the inlet region 5 into the separator device 1. The inlet pressure generated on the compressor side exerts a force on the spring element or on the leaf spring 11 of the closure element 8 and thereby opens the closure element 8. How far the closure element 8 opens thus depends on the inlet pressure, by influencing the pressure on the position of the leaf spring 11 relative to the opening, that is, the distance of one end of the leaf spring 11 to a sealing edge of the separator cylinder. This relationship is based on the formula Spring stiffness C=Pressure p/Displacement s. Preferably, the spring stiffness can be adjusted in a range of 0.1 to 5 bar/mm. This effective passage cross-section, which is dependent on the inlet pressure, determines with which flow velocity the coolant fluid flows into the separator cylinder 6. The deposition process is thus regulated via the flow velocity of the volume flow. The flow conditions prevailing within the separator device 1 remain substantially independent of the rotational speed of the compressor. As FIG. 4 shows, the inlets 4 and their guide channels 15 can be closed and opened at least partially by the leaf spring 11 and thus regulate the inlet of the coolant fluid flow such that a constantly high flow velocity of the coolant fluid within the separator cylinder 6 is present independent of the rotational speed of the compressor. This is made possible by the variation of the passage cross-section of the inlets 4 by means of the leaf spring 11, on which the continuously flowing volume flow exerts a force. The closure element 8 therefore provides an element which automatically regulates the entering flow velocity.

The coolant fluid circulates in the embodiment shown in the tangential direction Z around the tube section 10 of the separation tube 7 similar to a cyclone. Due to the effect of the centrifugal forces on the coolant fluid, the lubricant or the oil, due to its higher mass, is spun from the flow against the inner wall of the separator cylinder 6 and accumulates there. The oil particles then flow or move within the separator cylinder 6 in a direction A to the outlet region 3 and are conducted via a collection basin connection 9 into a collection basin. The lighter coolant, however, rises through the separation tube 7 and is supplied in the direction R via a cooling circuit connection 12 to the cooling circuit. Later, the oil located in the collection basin is again mixed with coolant to form a coolant aerosol again and to further be able to supply the compressor parts again.

Each inlet 4 may further comprise a guide channel 15 which extends in a direction deviating from the radial direction, so that the volume flow flows into the separator cylinder substantially in a tangential direction.

Furthermore, it is possible that when the compressor 20 is at standstill, a backflow of the coolant fluid is prevented in the compressor 20 when the inlets 4 are closed. For this purpose, for example, a pressure relief valve 25, shown in FIGS. 2 and 3A to 3C, may be provided, which is arranged between separator cylinder 6 and the collection basin for the oil. Due to the prevailing pressure during the deposition, the pressure relief valve 25 is usually open to allow the oil to drain off. Since no pressure difference is present during non-operation, or at standstill of the device, the pressure relief valve 25 is closed and thus prevents the backflow of the coolant fluid into the compressor 20.

FIG. 6 shows a plan view of a compressor housing 20 having a separator cylinder 60 and a closure element 80. The closure element 80 is shown in perspective in FIG. 7.

The closure element 80 according to the further embodiment includes a leaf spring 110 and is arranged in or on the separator cylinder 60 such as to open or close an inlet 40 to regulate the flow velocity of the volume flow through a guide channel 150. In this embodiment, the positioning, or the bending of the leaf spring 110 can be changed until it rests against a stop 30 at maximum deflection. In other words, the leaf spring 110 can be bent backwards to the maximum extent until the leaf spring 110 reaches the stop 30, and the inlet 40 is fully opened. The deflection of the leaf spring 110 as a function of the inlet pressure is predetermined by the spring stiffness.

As the pressure decreases, the leaf spring 110 is moved in the opposite direction. A spring edge 111 of the leaf spring 110 terminates with a sealing edge 112 of the separator cylinder 60 and closes the inlet 40, or the guide channel 150 completely when the pressure falls below a limit predetermined by the spring stiffness. The deflection of the leaf spring 110 thus depends on the pressure, so that a self-regulation of the flow velocity is given.

The invention is not limited to the embodiments of the separator device shown in the drawings, but results from a synopsis of all features disclosed herein.

LIST OF REFERENCE NUMBERS

Separator device 1
Compressor housing 2, 20
Outlet region 3
Inlet 4, 40
Inlet region 5
Separator cylinder 6, 60
Separation tube 7
Closure element 8, 80
Collection basin connection 9
Tube section 10
Leaf spring 11, 110
Cooling circuit connection 12, 120
Section 13
Separation tube section 14
Guide channel 15, 150
Compressor 20
Overpressure valve 25
Stop 30
Spring edge 111
Sealing edge 112
Recycling coolant R
Deposition Oil A
Tangential direction Z
Section plane II
Section plane IIIB
Section plane IV

The invention claimed is:

1. A separator device for deposition of a lubricant from a coolant fluid comprising:

a separator cylinder having an inlet region with at least one inlet for the coolant fluid and an outlet region for the deposited lubricant, the inlet region spaced apart from the outlet region in an axial direction of the separator cylinder;

a separation tube configured and arranged coaxially in the separator cylinder, the separation tube extending at least over the inlet region such that the separation tube is spaced apart from the separator cylinder in a radial direction in the inlet region; and a spring-loaded closure configured and arranged in the inlet region to automatically regulate a flow velocity of a volume flow of the coolant fluid flowing through the at least one inlet, the spring-loaded closure configured as a bent leaf spring having a radius of curvature smaller than half an inner diameter of the separator cylinder.

2. The separator device according to claim 1 wherein the spring-loaded closure changes an effective passage cross-section of the at least one inlet as a function of an inlet pressure prevailing at the at least one inlet.

3. The separator device according to claim 2 wherein the radius of curvature of the leaf spring is variable.

4. The separator device according to claim 3, wherein the separator device is configured and arranged as a separate unit detachably connected to a housing of a compressor.

5. The separator device according to claim 2 wherein the at least one inlet further comprises a guide channel extending at least in sections in a direction deviating from the radial direction, so that the volume flow flows into the separator cylinder substantially in a tangential direction.

6. The separator device according to claim 2, wherein the at least one inlet includes a plurality of inlets configured and arranged circumferentially around the separator cylinder.

7. The separator device according to claim 1 wherein the radius of curvature of the leaf spring is variable.

8. The separator device according to claim 7 wherein the at least one inlet further comprises a guide channel extending at least in sections in a direction deviating from the radial direction, so that the volume flow flows into the separator cylinder substantially in a tangential direction.

9. The separator device according to claim 1 wherein the at least one inlet further comprises a guide channel extending at least in sections in a direction deviating from the radial direction, so that the volume flow flows into the separator cylinder substantially in a tangential direction.

10. The separator device according to claim 9, wherein the separator device is configured and arranged as a separate unit detachably connected to a compressor housing of a compressor.

11. The separator device according to claim 1, wherein the at least one inlet includes a plurality of inlets configured and arranged circumferentially around the separator cylinder.

12. The separator device according to claim 1, wherein the at least one inlet includes a plurality of inlets configured and arranged circumferentially around the separator cylinder.

13. The separator device according to claim 12, wherein the plurality of inlets is closable.

14. The compressor device according to claim 13, wherein the separator device is configured and arranged as a separate unit detachably connected to a housing of the compressor.

15. The separator device according to claim 1, wherein the separator device is configured and arranged as a separate unit detachably connected to a housing of a compressor.

16. A compressor comprising:

a separator cylinder for depositing lubricant from a coolant fluid flowing in the compressor using centrifugal force in response to rotation of the compressor; and a spring-loaded closure included in the separator cylinder that regulates a flow velocity of a volume flow of the coolant fluid flowing through a plurality of inlets of the separator cylinder as a function of a pressure at the inlets, wherein the inlets are configured and arranged circumferentially around the separator cylinder, wherein the spring-loaded closure is configured as a bent leaf spring having a radius of curvature smaller than half an inner diameter of the separator cylinder.

17. The compressor according to claim 16, wherein the plurality of inlets are configured and arranged in a row extending perpendicular to the axial direction.

18. The compressor according to claim 16, wherein the plurality of inlets is closable.

19. The compressor according to claim 16, wherein the separator device is configured and arranged as a separate unit detachably connected to a housing of the compressor.

20. A compressor comprising:

a compressor housing;

a separator detachably connected to the compressor housing, wherein the separator is configured to deposit lubricant from a coolant fluid flowing in the compressor using centrifugal force in response to rotation of the compressor; and a spring-loaded closure included in the separator that regulates a flow velocity of a volume flow of the coolant fluid flowing through an inlet of the separator such that the flow velocity is maintained as rotational speed of the compressor varies, wherein the spring-loaded closure is configured as a bent leaf spring having a radius of curvature smaller than half an inner diameter of the separator.

* * * * *